US011462164B1

(12) United States Patent
Orio et al.

(10) Patent No.: US 11,462,164 B1
(45) Date of Patent: Oct. 4, 2022

(54) DEVICE AND METHOD FOR COMPENSATING A VOLTAGE DROP IN DISPLAY PANELS DRIVEN BY MULTIPLE DISPLAY DRIVERS

(71) Applicant: Synaptics Incorporated, San Jose, CA (US)

(72) Inventors: Masao Orio, Tokyo (JP); Hirobumi Furihata, Tokyo (JP); Takashi Nose, Kanagawa (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 17/402,950

(22) Filed: Aug. 16, 2021

(51) Int. Cl.
*G09G 3/325* (2016.01)
*G09G 3/3291* (2016.01)

(52) U.S. Cl.
CPC ..... *G09G 3/325* (2013.01); *G09G 3/3291* (2013.01); *G09G 2320/0223* (2013.01)

(58) Field of Classification Search
CPC ..... G09G 3/325; G09G 3/3291; G09G 2320/0223
See application file for complete search history.

(56) References Cited

U.S. PATENT DOCUMENTS

2020/0111423 A1* 4/2020 Orio ..... G09G 3/3225
2020/0143751 A1* 5/2020 Byun ..... G09G 3/3291
2020/0312253 A1* 10/2020 Kim ..... G09G 3/3266

* cited by examiner

*Primary Examiner* — Kenneth B Lee, Jr.
(74) *Attorney, Agent, or Firm* — Ferguson Braswell Fraser Kubasta PC

(57) ABSTRACT

A display system includes a display panel and first and second display drivers. The first display driver is configured to generate first region total current data corresponding to a subtotal of estimated pixel currents of respective pixels in a first region of the display panel. The second display driver is configured to generate second region total current data corresponding to a subtotal of estimated pixel currents of respective pixels in a second region of the display panel. The first display driver is further configured to receive the second region total current data from the second display driver, receive first image data for the first region; generate first voltage data based on the first image data, and update the first region of the display panel based on the first voltage data. Generating the first voltage data includes an IR-drop compensation based on the first and second region total current data.

20 Claims, 14 Drawing Sheets

DEVICE AND METHOD FOR COMPENSATING A VOLTAGE DROP IN DISPLAY PANELS DRIVEN BY MULTIPLE DISPLAY DRIVERS

FIELD

The disclosed technology generally relates to a display driver, display module and method for driving a display panel.

BACKGROUND

Some sorts of display panels, such as organic light emitting diode (OLED) display panels, are configured to supply a power supply voltage to respective pixels via power supply lines. A display panel thus configured may exhibit display mura in a displayed image due to voltage drop across the power supply lines in the display panel.

SUMMARY

This summary is provided to introduce in a simplified form a selection of concepts that are further described below in the detailed description. This summary is not intended to identify key features or essential features of the claimed subject matter, nor is it intended to limit the scope of the claimed subject matter.

In one or more embodiments, a display system is provided. The display system includes a display panel, a first display driver, and a second display driver. The display panel includes a first region and a second region. The first display driver is configured to generate first region total current data corresponding to a subtotal of estimated pixel currents of respective pixels in the first region. The second display driver is configured to generate second region total current data corresponding to a subtotal of estimated pixel currents of respective pixels in the second region. The first display driver is further configured to receive the second region total current data from the second display driver, receive first image data for the first region; generate first voltage data based on the first image data, and update the first region of the display panel based on the first voltage data. Generating the first voltage data includes an IR-drop compensation based on the first region total current data and the second region total current data.

In one or more embodiments, a display driver is provided. The display driver includes image processing circuitry, driver circuitry, and communication circuitry. The image processing circuitry is configured to receive image data for a first region of a display panel and generate first region total current data corresponding to a subtotal of estimated pixel currents of respective pixels in the first region. The image processing circuitry is further configured to generate voltage data from the image data for the first region. The driver circuitry is configured to update the first region based on the voltage data. The communication circuitry configured to receive second region total current data from a second display driver, the second region total current data corresponding to a subtotal of estimated pixel currents of respective pixels in a second region of the display panel. Generating the voltage data includes an IR-drop compensation based on the first region total current data and the second region total current data.

In one or more embodiments, a method for driving a display panel is provided. The method includes generating, by a first display driver, first region total current data corresponding to a subtotal of estimated pixel currents of respective pixels in a first region of a display panel. The method further includes generating, by a second display driver, second region total current data corresponding to a subtotal of estimated pixel currents of respective pixels in a second region of the display panel. The method further includes transmitting the second region total current data from the second display driver to the first display driver and generating, by the first display driver, first voltage data based on first image data for the first region. Generating the first voltage data includes an IR-drop compensation based on the first region total current data and the second region total current data. The method further includes updating the first region based on the first voltage data.

Other aspects of the embodiments will be apparent from the following description and the appended claims.

BRIEF DESCRIPTION OF DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments, and are therefore not to be considered limiting of inventive scope, as the disclosure may admit to other equally effective embodiments.

Figure 1:
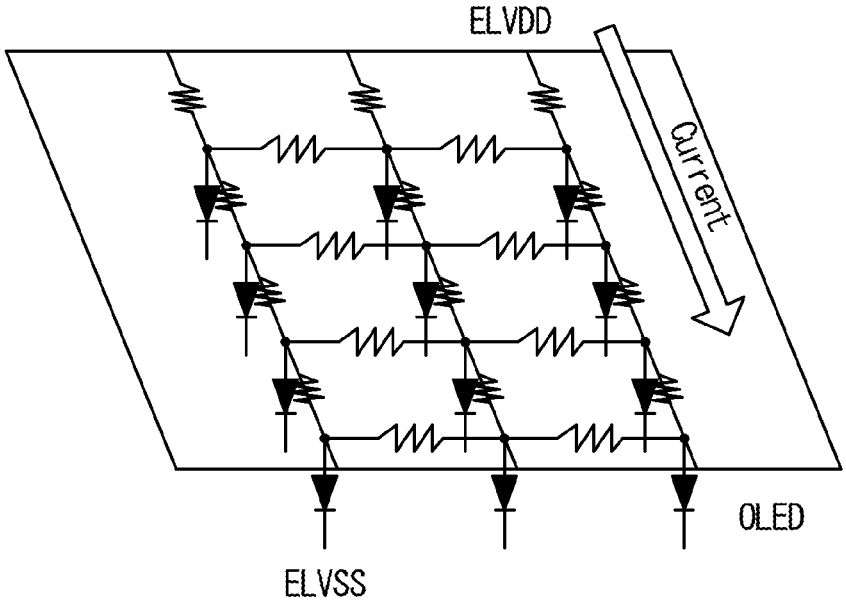
FIG. 1 illustrates an example configuration of a display panel, according to one or more embodiments.

To facilitate understanding, identical reference numerals have been used, where possible, to designate identical elements that are common to the figures. It is contemplated that elements disclosed in one embodiment may be beneficially utilized in other embodiments without specific recitation. Suffixes may be attached to reference numerals for distinguishing identical elements from each other. The drawings referred to herein should not be understood as being drawn to scale unless specifically noted. Also, the drawings are often simplified and details or components omitted for clarity of presentation and explanation. The drawings and discussion serve to explain principles discussed below, where like designations denote like elements.

DETAILED DESCRIPTION

The following detailed description is merely exemplary in nature and is not intended to limit the disclosure or the application and uses of the disclosure. Furthermore, there is no intention to be bound by any expressed or implied theory presented in the preceding background, summary, or the following detailed description.

Some sorts of display panels, such as organic light emitting diode (OLED) display panels, are configured to supply a power source voltage to respective pixels via power supply lines. For example, in embodiments where the pixels include current-driven light emitting elements (e.g., OLED elements), the display panel may be configured to supply a power supply voltage to the respective pixels to drive the current-driven light emitting elements.

FIG. 1 illustrates an example configuration of a display panel, according to one or more embodiments. The display panel of FIG. 1 is configured as an organic light emitting diode (OLED) display panel in which each pixel includes an OLED, which is a sort of current-driven element. To drive the OLEDs, the display panel is configured to supply or deliver a power supply voltage ELVDD to the respective pixels via power supply lines. "ELVSS" in FIG. 1 refers to a ground voltage.

The display panel thus configured may suffer from display mura in a displayed image due to voltage drop across the power supply lines in the display panel. The voltage drop may be also referred to as IR-drop, as the voltage drop results from the currents traveling through the power supply lines, which function as resistances. The IR-drop across the power supply lines may reduce the luminances of the pixels depending on the position in the display panel and thereby cause display mura.

Figure 2:
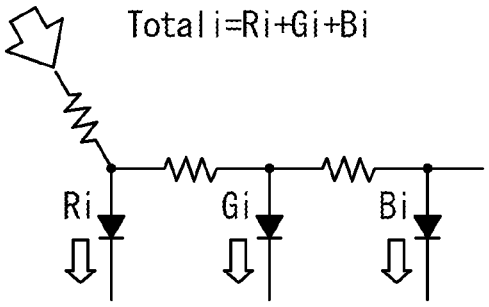
FIG. 2 illustrates an example total current of a display panel, according to one or more embodiments.
Figure 3:
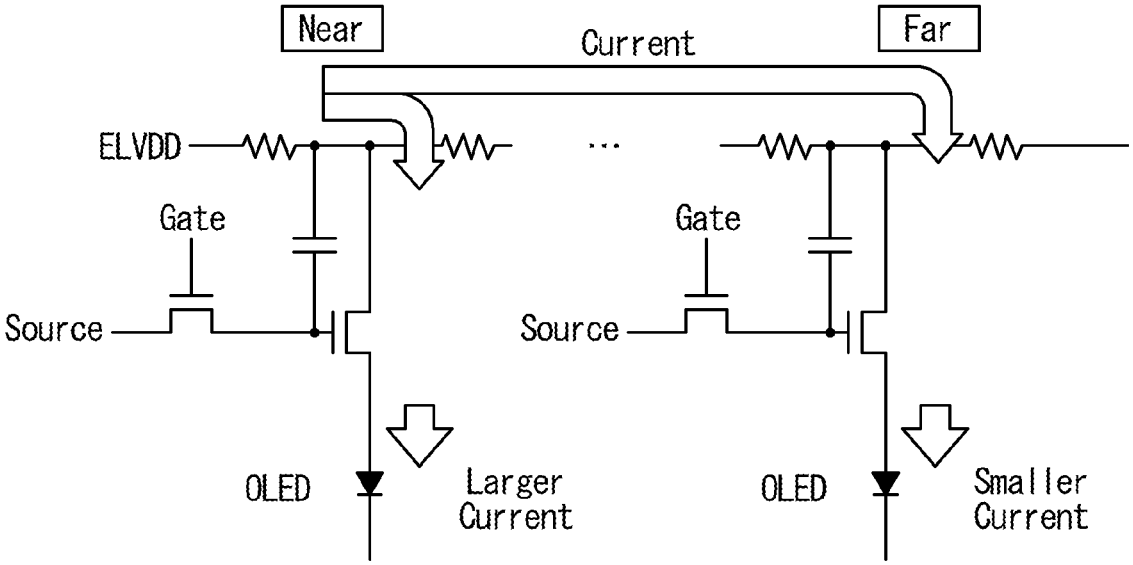
FIG. 3 illustrates example luminance reduction of a pixel, according to one or more embodiments.

The luminance reduction of a pixel caused by the IR-drop depends on at least two factors: the total current of the display panel and the position of the pixel in the display panel. Referring to FIG. 2, the total current referred herein may be the sum of the currents travelling through all the pixels (three shown in FIG. 2.) An increase in the total current of the display panel causes an increased voltage drop along the path that delivers the power supply voltage to the pixel, reducing the luminance of the pixel. Further, as illustrated in FIG. 3, the luminance reduction caused by the IR-drop depends on the position of the pixel in the display panel. The length of the path along which the power supply voltage ELVDD is supplied to the pixel is dependent on the position of the pixel. A pixel positioned away from the power supply may experience an increased IR-drop over the power supply line. The increased IR-drop may reduce the current through the pixel, causing an increased luminance reduction.

One approach to mitigate the display mura caused by the IR-drop in the display panel is to use a display driver (e.g., a display driver integrated circuit (DDIC)) configured to apply an image process to image data to compensate the IR-drop. The image process to compensate the IR-drop may be hereinafter referred to as IR-drop compensation. The IR-drop compensation may modify the image data depending on expected luminance reductions of the respective pixels caused by the IR-drop. To effectively suppress the display mura, the IR drop compensation may be based on the total current of the display panel and/or the position of the pixel of interest.

Meanwhile, a display device may be configured to drive a single display panel with multiple display drivers. Use of multiple display drivers is a common technique to drive large-sized display panels (e.g., center information displays (CIDs) for automotive applications and foldable display panels). In embodiments where the display panel is large-sized and include an increased number of source lines (or data lines), for example, two or more display drivers are used to drive the source lines of the display panel due to the restriction of the maximum number of the outputs of each display driver. The present disclosure provides various technologies for effectively performing an IR-drop compensation for a display device configured to drive a single display panel with multiple display drivers.

Figure 4:
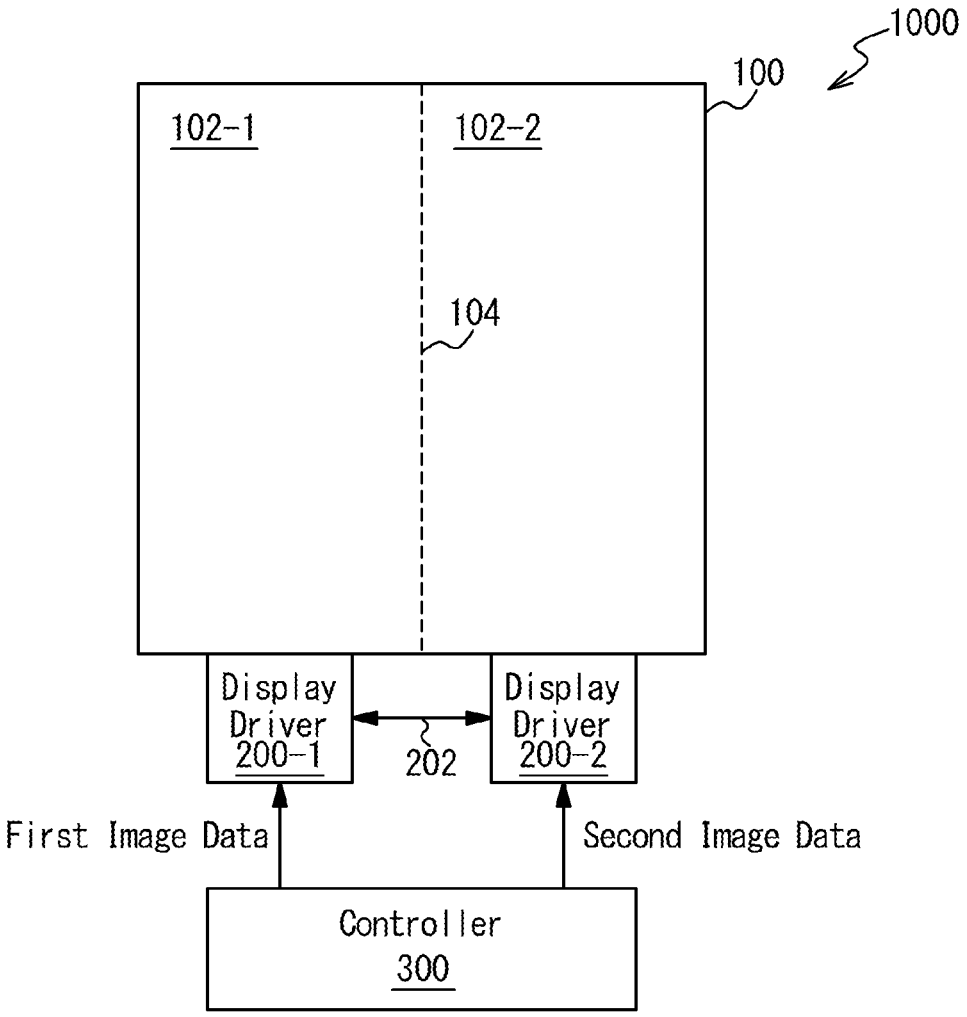
FIG. 4 illustrates an example configuration of a display system, according to one or more embodiments.

FIG. 4 illustrates an example configuration of a display system 1000, according to one or more embodiments. The display system 1000 is configured to display an image on a display panel 100 under control of a controller 300. In the illustrated embodiment, the display system 1000 includes a first display driver 200-1 and a second display driver 200-2. The display panel 100 includes a first region 102-1 and a second region 102-2 which adjoin each other at a boundary 104. The first display driver 200-1 is configured to receive first image data for the first region 102-1 from the controller 300 and update pixels in the first region 102-1 based on the first image data. The second display driver 200-2 is configured to receive second image data for the second region 102-2 from the controller 300 and update pixels in the second region 102-2 based on the second image data. The first display driver 200-1, which is positioned leftward in FIG. 4, may be referred to as "left driver", and the second display driver 200-2, which is positioned rightward in FIG. 4, may be referred to as "right driver", The first display driver 200-1 and the second display driver 200-2 are communicably coupled to each other via a communication bus 202. In one or more embodiments, the first display driver 200-1 and the second display driver 200-2 are configured to exchange information and/or data via the communication bus 202. As described later in detail, the first display driver 200-1 may be configured to generate first region total current data corresponding to a subtotal of estimated pixel currents of respective pixels in the first region 102-1 and transmit the first region total current data to the second display driver 200-2 via the communication bus 202. Further, the second display driver 200-2 may be configured to generate second region total current data corresponding to a subtotal of estimated pixel currents of respective pixels in the second region 102-2 and transmit the second region total current data to the first display driver 200-1 via the communication bus 202. The first display driver 200-1 and the second display driver 200-2 may be each configured to perform an IR-drop compensation based on the first region total current data and the second region total current data.

Figure 5:
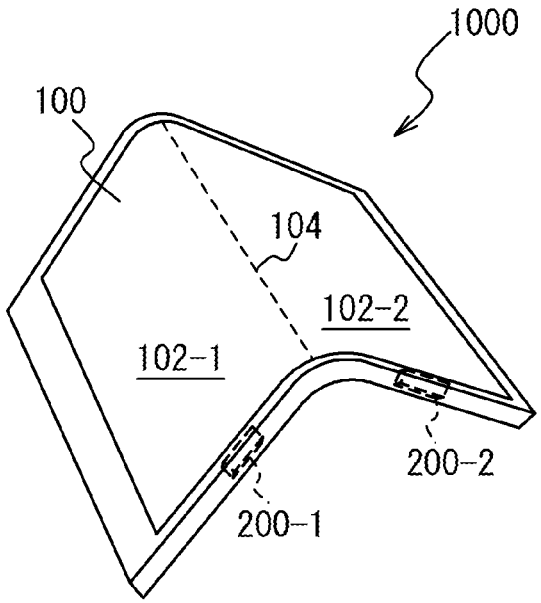
FIG. 5 illustrates an example implementation of the display system, according to one or more embodiments.

FIG. 5 illustrates an example implementation of the display system 1000, according to one or more embodiments. In the illustrated implementation, the display panel 100 is foldable at the boundary 104 between the first region 102-1 and the second region 102-2. The use of two display drivers (e.g., the first display driver 200-1 and the second display driver 200-2) facilitates designing of the display system 1000 with a foldable feature.

Figure 6:
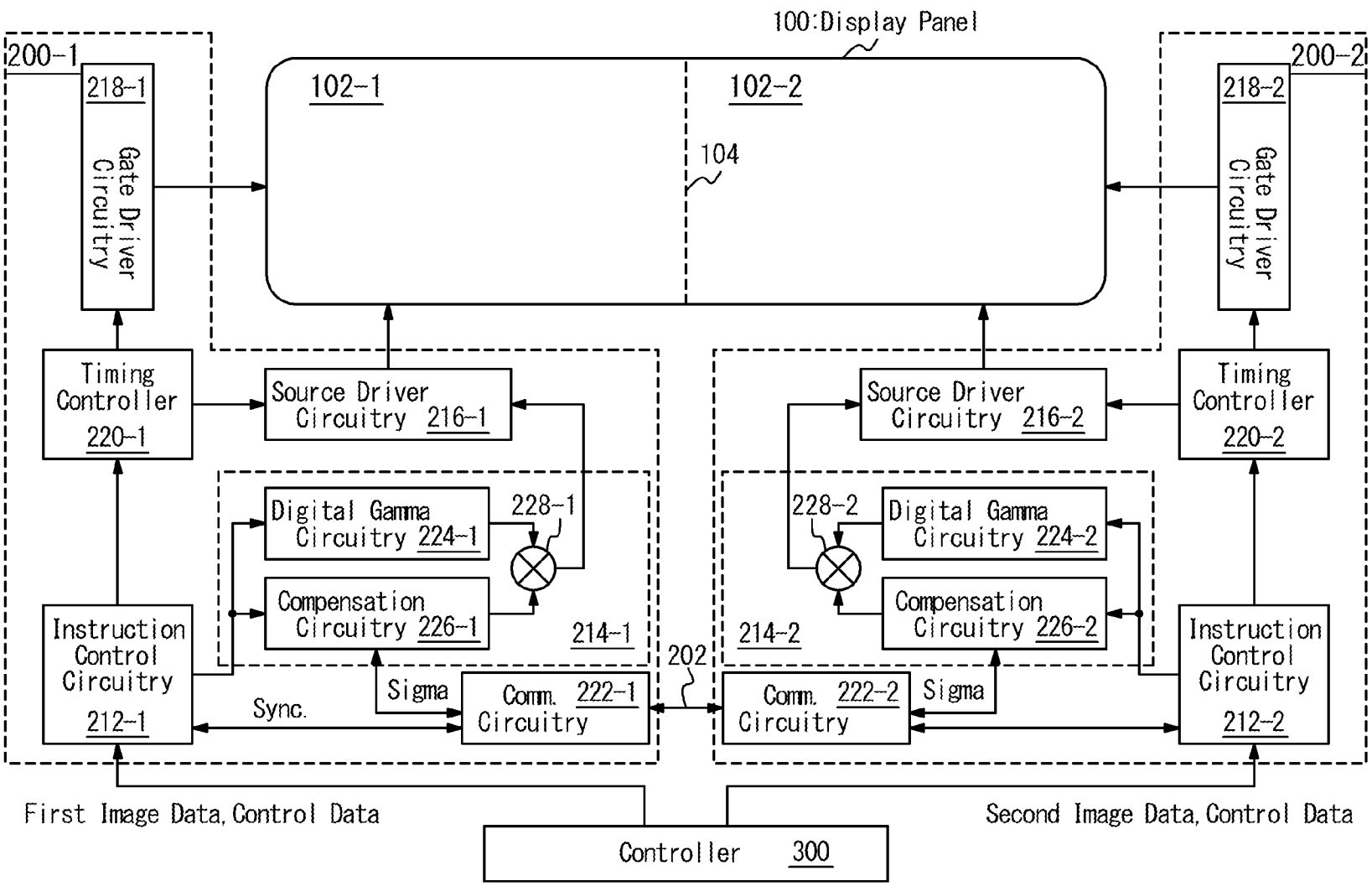
FIG. 6 illustrates example configurations of a first display driver and a second display driver, according to one or more embodiments.

FIG. 6 illustrates example configurations of the first display driver 200-1 and the second display driver 200-2, according to one or more embodiments. In the illustrated embodiment, the first display driver 200-1 and the second display driver 200-2 are identically configured to each other. Other embodiments may include a first display driver which is configured differently from the second display driver. The first display driver 200-1 includes instruction control circuitry 212-1, image processing circuitry 214-1, source driver circuitry 216-1, gate driver circuitry 218-1, a timing controller 220-1, and communication circuitry 222-1, while the second display driver 200-2 includes instruction control circuitry 212-2, image processing circuitry 214-2, source driver circuitry 216-2, gate driver circuitry 218-2, a timing controller 220-2, and communication circuitry 222-2.

The instruction control circuitry 212-1 of the first display driver 200-1 is configured to receive first image data for the first region 102-1 of the display panel 100 from the controller 300 and forward the first image data to the image processing circuitry 214-1. The first image data may include graylevels of pixels in the first region 102-1 of the display panel 100. The instruction control circuitry 212-1 is further configured to receive control data from the controller 300 and control the operation of the first display driver 200-1.

Correspondingly, the instruction control circuitry 212-2 of the second display driver 200-2 is configured to receive second image data for the second region 102-2 of the display panel 100 from the controller 300 and forward the second image data to the image processing circuitry 214-2. The second image data may include graylevels of pixels in the second region 102-2 of the display panel 100. The instruction control circuitry 212-2 is further configured to receive control data from the controller 300 and control the operation of the second display driver 200-2.

The image processing circuitry 214-1 of the first display driver 200-1 is configured to process the first image data and generate first voltage data for the first region 102-1 of the display panel 100 based on the first image data. The first voltage data for the first region 102-1 may include voltage levels with which pixels in the first region 102-1 of the display panel 100 are to be updated. As described later in detail, the image processing performed by the image processing circuitry 214-1 includes an IR-drop compensation for the pixels in the first region 102-1.

Correspondingly, the image processing circuitry 214-2 of the second display driver 200-2 is configured to process the second image data and generate second voltage data for the second region 102-2 of the display panel 100 based on the second image data. The second voltage data for the second region 102-2 may include voltage levels with which pixels in the second region 102-2 of the display panel 100 are to be updated. The image processing performed by the image processing circuitry 214-2 includes an IR-drop compensation for the pixels in the second region 102-2.

The source driver circuitry 216-1 of the first display driver 200-1 is configured to update the pixels in the first region 102-1 based on the first voltage data received from the image processing circuitry 214-1. The source driver circuitry 216-1 may be configured to generate drive voltages with voltage levels specified by the first voltage data and update or program the corresponding pixels in the first region 102-1 with the drive voltages thus generated.

Correspondingly, the source driver circuitry 216-2 of the second display driver 200-2 is configured to update the pixels in the second region 102-2 based on the second voltage data received from the image processing circuitry 214-2. The source driver circuitry 216-2 may be configured to generate drive voltages with voltage levels specified by the second voltage data and update or program the corresponding pixels in the second region 102-2 with the drive voltages thus generated.

The gate driver circuitry 218-1 of the first display driver 200-1 and the gate driver circuitry 218-2 of the second display driver 200-2 are collectively configured to drive or scan gate lines (which may be also referred to as scan lines) of the display panel 100. In some implementations, the gate driver circuitry 218-1 may be configured to drive every other gate lines and the gate driver circuitry 218-2 may be configured to drive every other remaining gate lines. In other implementations, the gate driver circuitry 218-1 may be configured drive all the gate lines from left, and the gate driver circuitry 218-2 may be configured drive all the gate lines from right.

The timing controller 220-1 of the first display driver 200-1 is configured to control the operation timing of the first display driver 200-1 based on the control data received from the instruction control circuitry 212-1. Correspondingly, the timing controller 220-2 of the second display driver 200-2 is configured to control the operation timing of the second display driver 200-2 based on the control data received from the instruction control circuitry 212-2.

The communication circuitry 222-1 of the first display driver 200-1 and the communication circuitry 222-2 of the second display driver 200-2 are configured to provide data communications between the first display driver 200-1 and the second display driver 200-2 via the communication bus 202. In one implementation, serial data communications may be used for the communications between the first display driver 200-1 and the second display driver 200-2. In one or more embodiments, data used for the IR-drop compensation are exchanged between the first display driver 200-1 and the second display driver 200-2 by using the communication circuitry 222-1 and 222-2 as described later in detail.

Figure 7A:
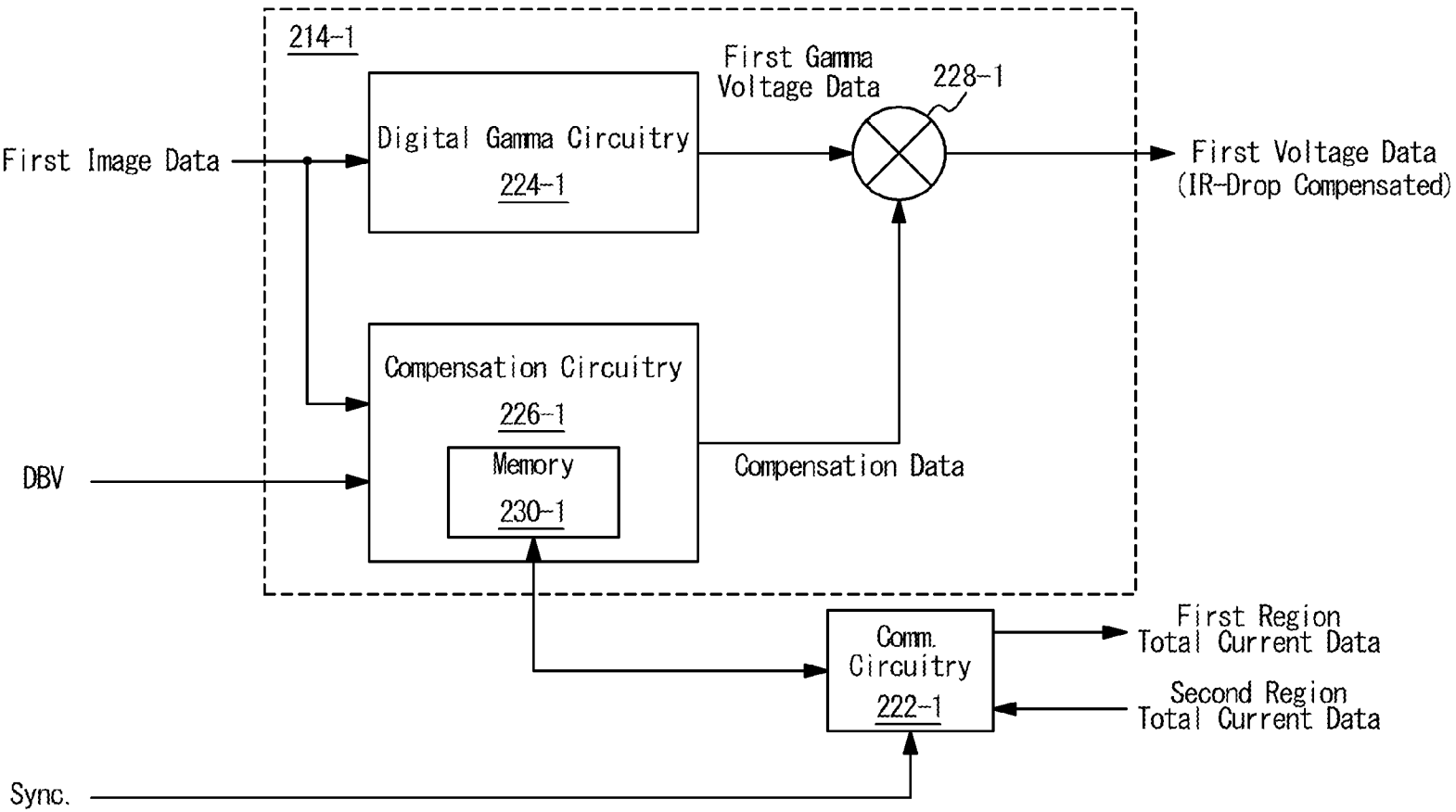
FIG. 7A illustrates an example configuration of image processing circuitry of a first display driver, according to one or more embodiments.

FIG. 7A illustrates an example configuration of the image processing circuitry 214-1 of the first display driver 200-1, according to one or more embodiments. In the illustrated embodiment, the image processing circuitry 214-1 includes digital gamma circuitry 224-1, compensation circuitry 226-1, and correction circuitry 228-1.

In one or more embodiments, the digital gamma circuitry 224-1 is configured to apply a gamma transformation to the first image data to generate first gamma voltage data. The first gamma voltage data may specify voltage levels of drive voltages for the respective pixels in the first region 102-1 of the display panel 100 to display an image corresponding to the first image data in the first region 102-1 with specified gamma characteristics.

The compensation circuitry 226-1 and the correction circuitry 228-1 are collectively configured to generate the first voltage data supplied to the source driver circuitry 216-1 (illustrated in FIG. 6) through applying an IR-drop compensation to the first gamma voltage data generated by the digital gamma circuitry 224-1. As discussed above, the IR-drop compensation is configured to compensate the IR-drop across the power source lines in the display panel 100. More specifically, the compensation circuitry 226-1 is configured to generate compensation data used for the IR-drop compensation, and the correction circuitry 228-1 is configured to correct the first gamma voltage data based on the compensation data to generate the first voltage data. In one or more embodiments, the compensation data generated by the compensation circuitry 226-1 may include compensation gains, and the correction circuitry 228-1 is configured to multiply the gamma voltage data with the compensation gains to generate the first voltage data. In embodiments the first gamma voltage data includes voltage levels of the drive voltages with which the respective pixels of the first region 102-1 are to be updated, the correction circuitry 228-1 may be configured to generate the first voltage data to include products acquired by multiplying the voltage levels of the drive voltages of the first gamma voltage data by the compensation gains.

Figure 7B:
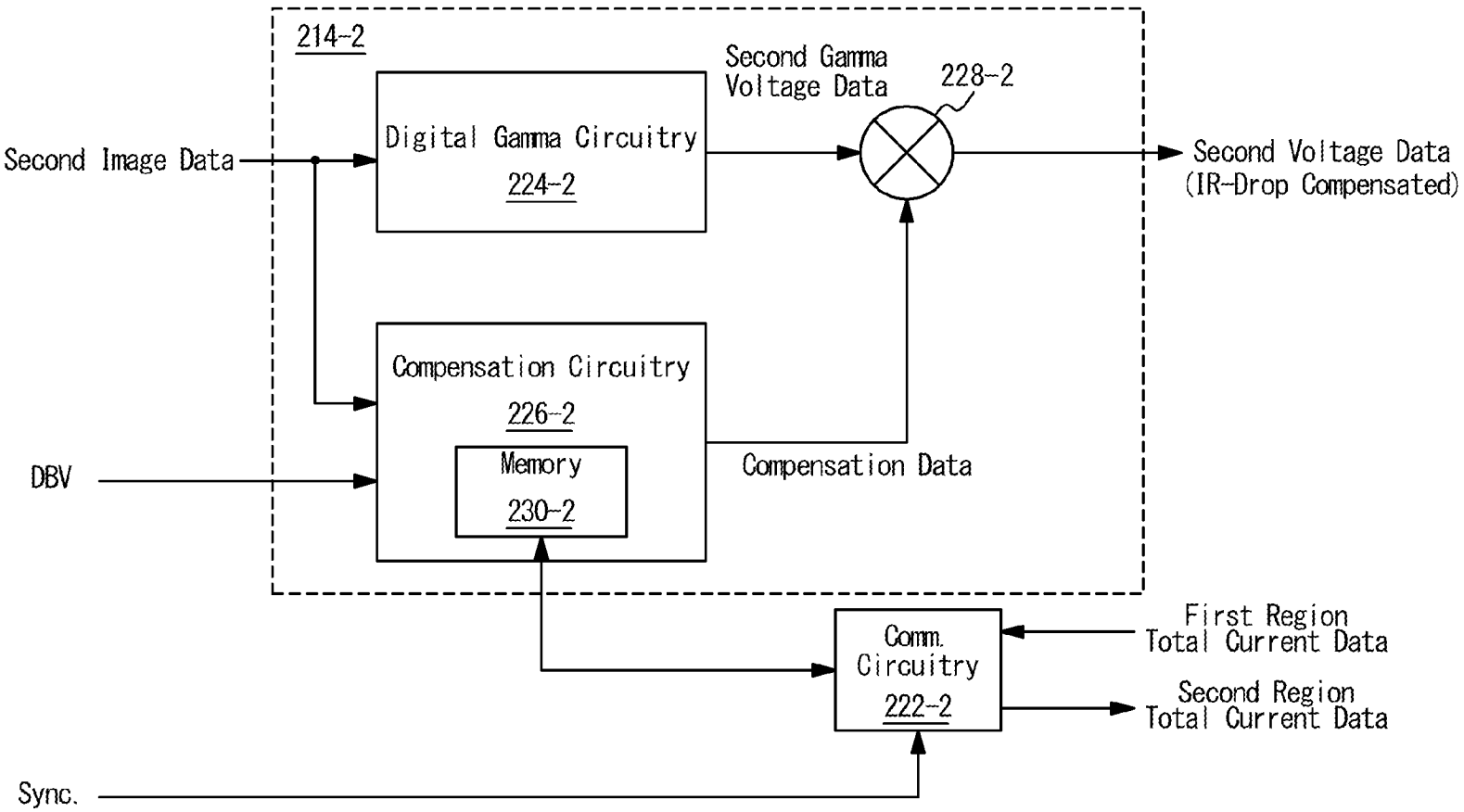
FIG. 7B illustrates an example configuration of image processing circuitry of a second display driver, according to one or more embodiments.

In one or more embodiments, as illustrated in FIG. 7B, the image processing circuitry 214-2 of the second display driver 200-2 is configured similarly to the image processing circuitry 214-1 of the first display driver 200-1 illustrated in FIG. 7A. In the illustrated embodiment, the image processing circuitry 214-2 of the second display driver 200-2 includes digital gamma circuitry 224-2, compensation circuitry 226-2, and correction circuitry 228-2, which correspond to the digital gamma circuitry 224-1, the compensation circuitry 226-1, and the correction circuitry 228-1 of FIG. 7A. In one or more embodiments, the digital gamma circuitry 224-2 is configured to apply a gamma transformation to the second image data to generate second gamma voltage data. The compensation circuitry 226-2 and the correction circuitry 228-2 are collectively configured to generate the second voltage data supplied to the source driver circuitry 216-2 (illustrated in FIG. 6) through applying an IR-drop compensation to the second gamma voltage data generated by the digital gamma circuitry 224-2. More specifically, the compensation circuitry 226-2 is configured to generate compensation data used for the IR-drop compensation, and the correction circuitry 228-2 is configured to correct the gamma voltage data based on the compensation data to generate the second voltage data.

In one or more embodiments, the compensation data used for the IR-drop compensation for image data for a pixel of interest may be generated based on the position of the pixel of interest. As described above in relation to FIG. 3, the luminance reduction of a pixel of interest caused by the IR-drop across the power supply lines may depend on the position of the pixel of interest. Accordingly, the generation of the compensation data based on the position of the pixel of interest effectively improves the accuracy of the IR-drop compensation.

In one or more embodiments, the compensation data for the IR-drop compensation may be generated based on an estimated total current of the display panel 100. As described above, the luminance reduction caused by the IR-drop across the power supply lines may depend on the total current of the display panel 100, and therefore the generation of the compensation data based on the estimated total current of the display panel 100 effectively improves the accuracy of the IR-drop compensation.

One issue is that the image processing circuitry 214-1 of the first display driver 200-1 is configured to receive only the first image data for the first region 102-1 while the image processing circuitry 214-2 of the second display driver 200-2 is configured to receive only the second image data for the second region 102-2. The first image data do not offer sufficient information to determine the estimated total current of the display panel 100 by itself. The same applies to the image processing circuitry 214-2 of the second display driver 200-2, which is configured to receive only the second image data for the second region 102-2.

To address this issue, in one or more embodiments, the compensation circuitry 226-1 of the first display driver 200-1 may be configured to generate and transmit first region total current data to the compensation circuitry 226-2 of the second display driver 200-2 based on the first image data for the first region 102-1 via the communication circuitry 222-1. The first region total current data may correspond to a total of estimated pixel currents of respective pixels in the first region 102-1. In one implementation, the compensation circuitry 226-1 may be configured to determine estimated pixel currents of the respective pixels in the first region 102-1 based on the first image data for the first region 102-1 and determine the total for the first region 102-1 by adding up the estimated pixel currents of the respective pixels in the first region 102-1. In one implementation, the first image data may include grey levels of the pixels in the first region 102-1 and the compensation circuitry 226-1 may be configured to determine the estimated pixel currents based on the grey levels of the pixels. The estimated pixel current for a pixel may be determined such that the estimated pixel current increases as the grey level for the pixel increases. The estimated pixel currents of the respective pixels may be further based on a display brightness value (DBV) that indicates a specified brightness level of the display panel 100. The brightness level of the display panel 100 referred herein may be the brightness level of the entire image displayed on the display panel 100. In one implementation, the controller 300 is configured to provide the DBV to the first display driver 100-1 to control the overall brightness level of the displayed image. The estimated pixel currents of the respective pixels may increase as the DBV increases.

Further, the compensation circuitry 226-2 of the second display driver 200-2 may be configured to generate and transmit second region total current data to the compensation circuitry 226-1 of the first display driver 200-1 based on the second image data for the second region 102-2 via the communication circuitry 222-2. The generation of the second region total current data may be achieved in a similar manner to the generation of the first region total current data except for that the second region total current data are generated from the second image data for the second region 102-2. The second region total current data may correspond to a total of estimated pixel currents of respective pixels in the second region 102-2. In one implementation, the compensation circuitry 226-2 may be configured to determine estimated pixel currents of the respective pixels in the second region 102-2 based on the second image data for the second region 102-2 and determine the total for the second region 102-2 by adding up the estimated pixel currents of the respective pixels in the second region 102-2. The estimated pixel currents of the respective pixels may be further based on the DBV.

The compensation circuitry 226-1 of the first display driver 200-1 may be configured to receive the second region total current data from the compensation circuitry 226-2 of the second display driver 200-2 and store the first region total current data and the second region total current data in a memory 230-1 as illustrated in FIG. 7A. Correspondingly, the compensation circuitry 226-2 of the second display driver 200-2 may be configured to receive the first region total current data from the compensation circuitry 226-1 of the first display driver 200-1 and store the first region total current data and the second region total current data in a memory 230-2 as illustrated in FIG. 7B.

Referring to FIG. 7A, the compensation circuitry 226-1 of the first display driver 200-1 may be further configured to determine the estimated total current of the display panel 100 based on the first region total current data generated by itself and the second region total current data received from the compensation circuitry 226-2 of the second display driver 200-2. The compensation circuitry 226-1 may be further configured to generate the compensation data for the IR-drop compensation based on the estimated total current of the display panel 100.

Correspondingly, as illustrated in FIG. 7B, the compensation circuitry 226-2 of the second display driver 200-2 may be further configured to determine the estimated total current of the display panel 100 based on the first region total current data received from the compensation circuitry 226-1 of the first display driver 200-1 and the second region total current data generated by itself. The compensation circuitry 226-2 may be further configured to generate the compensation data for the IR-drop compensation based on the estimated total current of the display panel 100.

Figure 8:
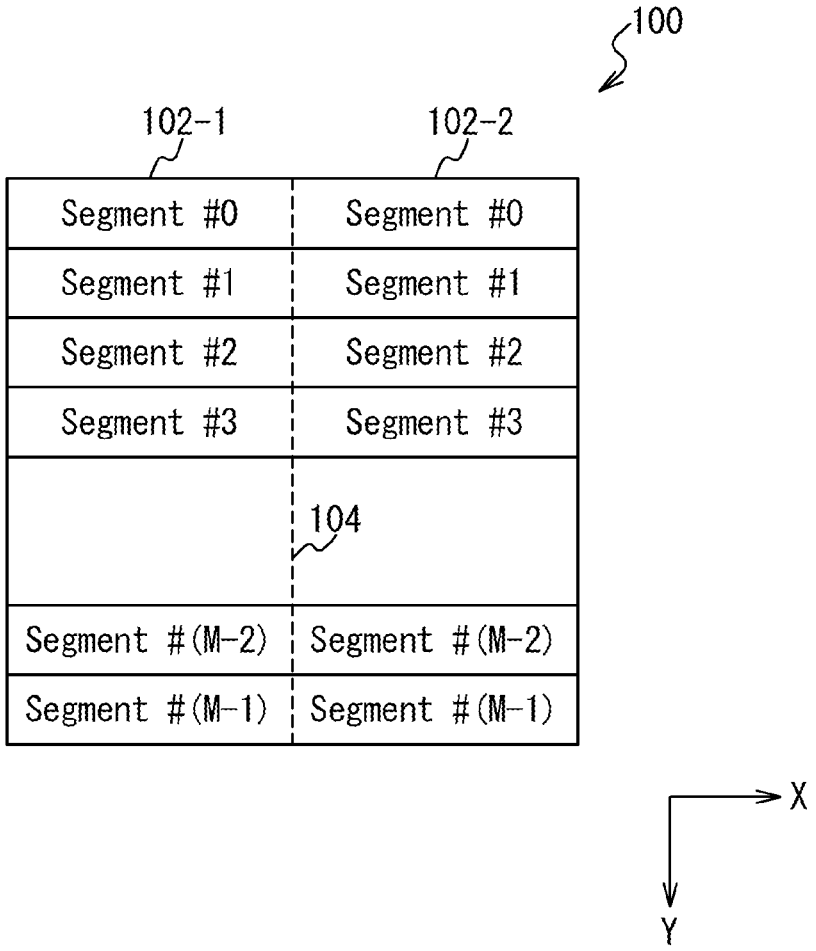
FIG. 8 illustrates example configurations of first and second regions of a display panel, according to one or more embodiments.

In one or more embodiments, as illustrated in FIG. 8, the first region 102-1 and the second region 102-2 may be each segmented into M segments #0 to #M−1 where M is an integer of two or more. In FIG. 8, the X axis is defined in the direction in which the gate lines of the display panel 100 are extended, and the direction of the X axis may be referred to as "horizontal direction." The Y axis is defined in the direction in which the source lines of the display panel 100 are extended, and the direction of the Y axis may be referred to as "vertical direction." Each of the segments #1 to #M−1 includes one or more rows of pixels arranged in the horizontal direction. In one or more embodiments, segments #0 to #M−1 of the first region 102-1 are vertically arranged to form the first region 102-1, and the segments #0 to #M−1 of the second region 102-2 are vertically arranged to form the second region 102-2. The segments #i of the first region 102-1 and the second region 102-2 are arranged to adjoin each other in the horizontal direction where i is any integer from 0 to M−1.

In embodiments where the first region 102-1 is segmented into M segments #0 to #M−1 as illustrated in FIG. 8, the compensation circuitry 226-1 of the first display driver 200-1 may be configured to determine (e.g., calculate) subtotals of the estimated pixel currents of respective segments #0 to #M−1 of the first region 102-1 and determine the subtotal of the estimated pixel currents of the first region 102-1 by adding up the subtotals determined for the respective segments #0 to #M−1. Correspondingly, in embodiments where the second region 102-2 is segmented into M segments #0 to #M−1 as illustrated in FIG. 8, the compensation circuitry 226-2 of the second display driver 200-2 may be configured to determine (e.g., calculate) subtotals of the estimated pixel currents of respective segments #0 to #M−1 of the second region 102-2 and determine the total of the estimated pixel currents of the second region 102-2 by adding up the subtotals determined for the respective segments #0 to #M−1.

Figure 9A:
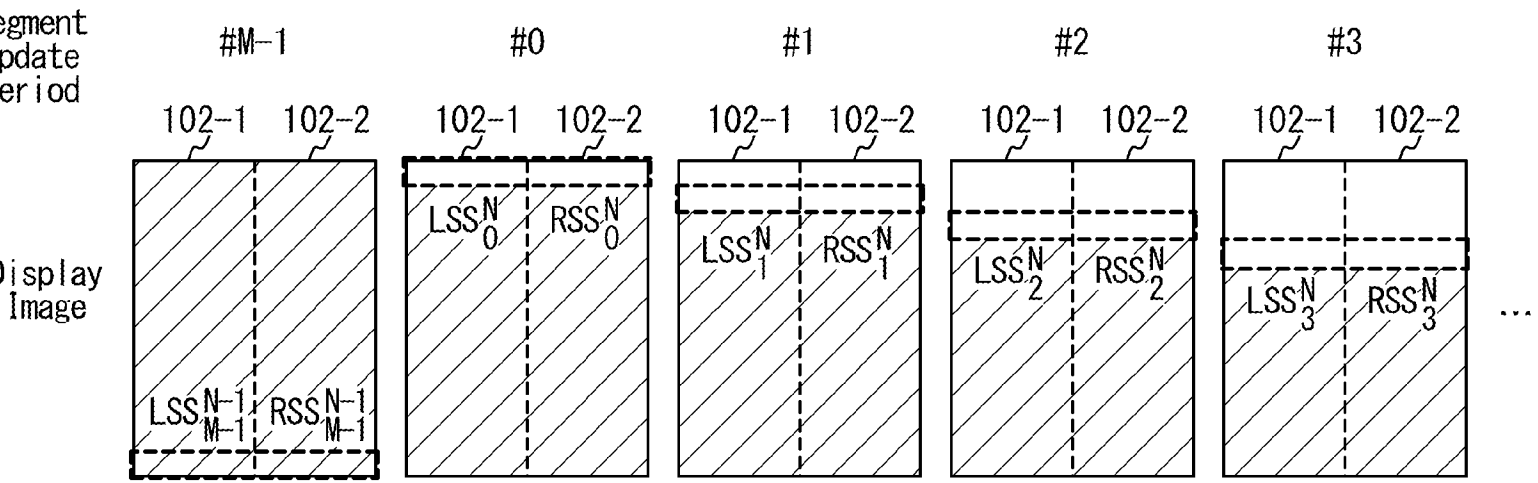
FIG. 9A and FIG. 9B illustrate an example update of respective segments of first and second regions of a display panel, according to one or more embodiments.
Figure 9B:
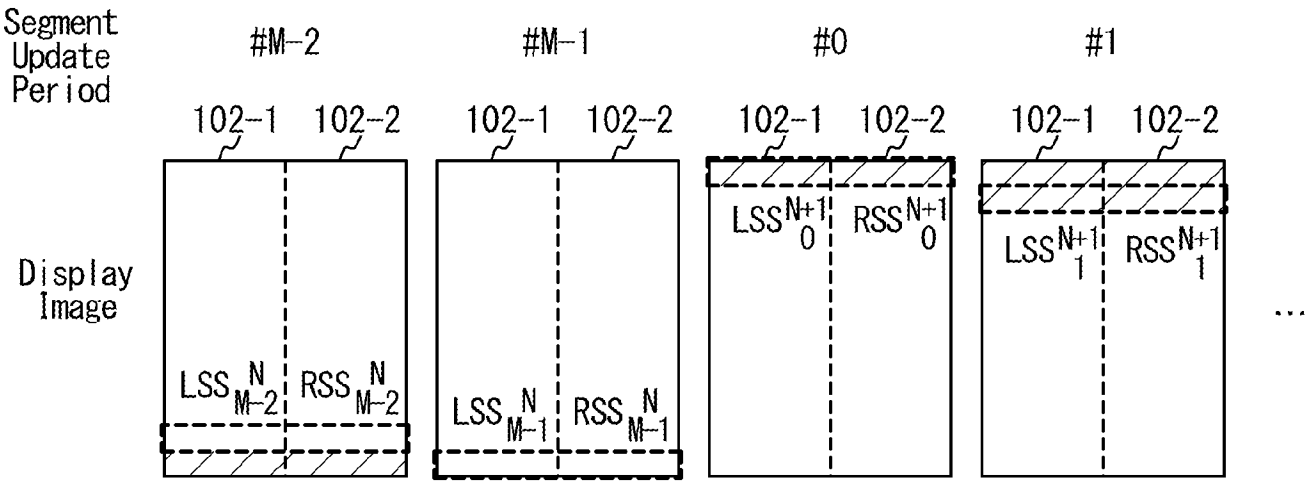

FIG. 9A and FIG. 9B illustrate an example update of the respective segments #0 to #M−1, according to one or more embodiments. In the illustrated embodiment, the first display driver 200-1 and the second display driver 200-2 are each configured to sequentially update segments #0 to #M−1 in each frame. Further, the first display driver 200-1 and the second display driver 200-2 are configured to concurrently update corresponding segments #i of the first region 102-1 and the second region 102-2, where i is an integer from 0 to M−1. For example, segments #0 of the first region 102-1 and the second region 102-2 are concurrently updated and segments #1 of the first region 102-1 and the second region 102-2 are concurrently updated. The same goes for other segments. A period during which the segments #i of the first region 102-1 and the second region 102-2 are updated may be hereinafter referred to as segment update period #i. For example, the first display driver 200-1 and the second display driver 200-2 may be configured to update segments #0 of the first region 102-1 and the second region 102-2 during segment update period #0 and update segments #1 of the first region 102-1 and the second region 102-2 during segment update period #1.

The compensation circuitry 226-1 of the first display driver 200-1 and the compensation circuitry 226-2 of the second display driver 200-2 may be configured to determine the subtotal of the estimated pixel currents of each segment upon the update of each segment. In FIG. 9A, "$LSS_i^j$" denotes the subtotal of estimated pixel currents of segment #i of the first region 102-1 upon the update of the segment #i of the first region 102-1 in frame #j, and "$RSS_i^j$" denotes the subtotal of segment #i of the second region 102-2 upon the update of the segment #i of the second region 102-2 in frame #j. For example, the compensation circuitry 226-1 of the first display driver 200-1 may be configured to calculate the subtotal $LSS_0^N$ of the estimated pixel currents of segment #0 of the first region 102-1 upon the update of segment #0 of the first region 102-1, and the compensation circuitry 226-2 of the second display driver 200-2 may be configured to calculate the subtotal $RSS_0^N$ of the estimated pixel currents of segment #0 of the second region 102-2 upon the update of segment #0 of the second region 102-2.

Figure 10A:
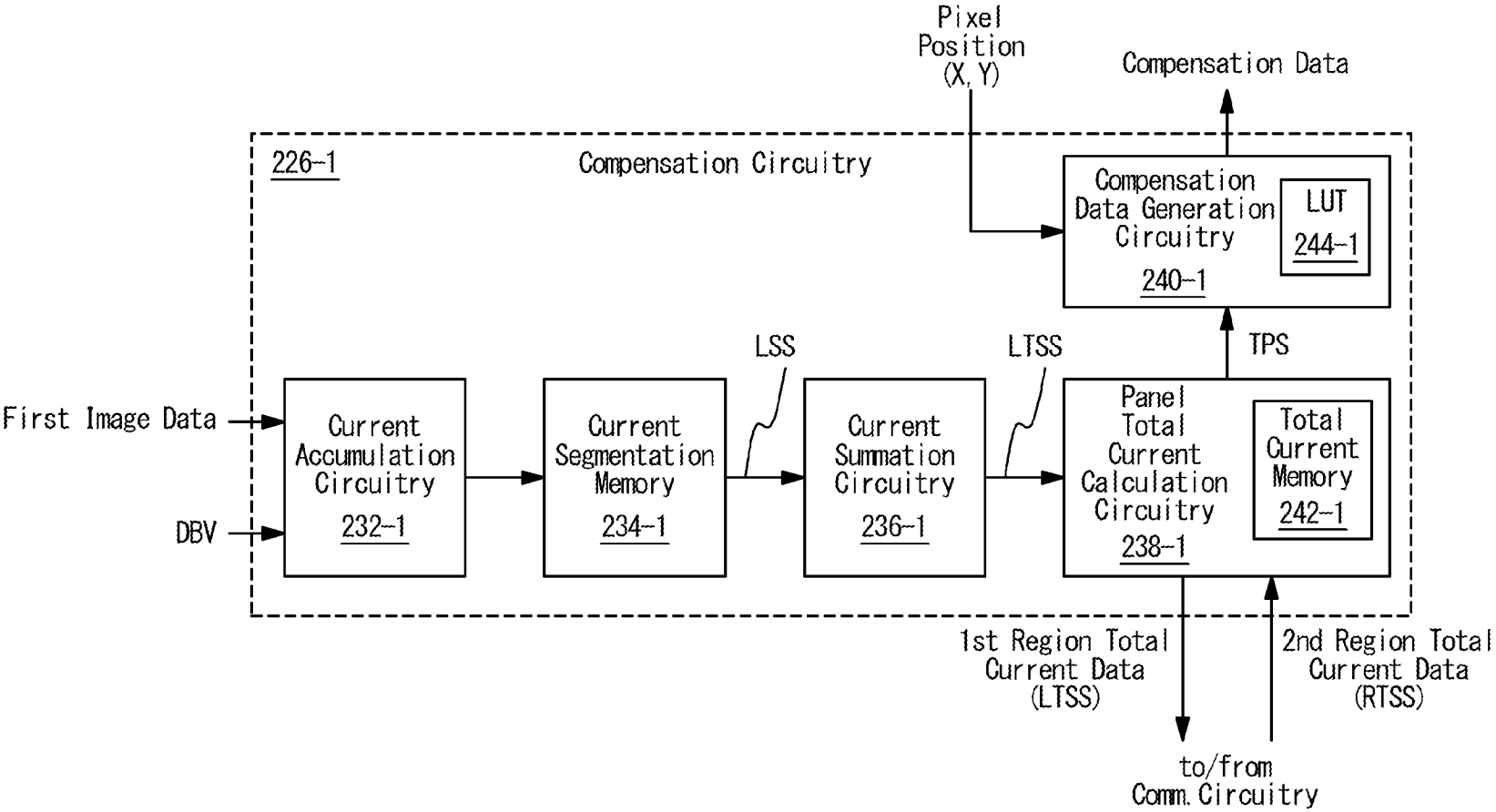
FIG. 10A illustrates an example configuration of compensation circuitry of a first display driver, according to one or more embodiments.

FIG. 10A illustrates an example configuration of the compensation circuitry 226-1 of the first display driver 200-1 configured to determine the subtotals of estimated pixel currents of segment #0 to #M−1 of the first region 102-1 and determine the subtotal of the estimated pixel currents of the first region 102-1 by adding up the subtotals of segment #0 to #M−1 of the first region 102-1, according to one or more embodiments. In the illustrated embodiment, the compensation circuitry 226-1 includes current accumulation circuitry 232-1, current segmentation memory 234-1, current summation circuitry 236-1, and panel total current calculation circuitry 238-1, and compensation data generation circuitry 240-1.

The current accumulation circuitry 232-1 is configured to determine estimated pixel currents of respective pixels of each segment in the first region 102-1 based on the first image data for the first region 102-1 and the DBV and determine the subtotal LSS of the estimated pixel currents of each segment in the first region 102-1. In one embodiment, the current accumulation circuitry 232-1 may be configured to determine an estimated pixel current of a pixel by calculating the luminance of the pixel based on the grey level of the pixel and calculating the estimated pixel current of the pixel as a product obtained by multiplying the luminance of the pixel by a coefficient determined depending on the DBV. The current accumulation circuitry 232-1 may be further configured to determine the subtotal of the estimated pixel currents of each segment in the first region 102-1 by adding up the estimated pixel currents of each segment. The current accumulation circuitry 232-1 may be further configured to forward the subtotal LSS of the estimated pixel currents of each segment to the current segmentation memory 234-1. The current segmentation memory 234-1 is configured to store the subtotals LSS of the estimated pixel currents of segments #0 to #M−1 of the first region 102-1.

The current summation circuitry 236-1 is configured to determine the subtotal LTSS of the estimated pixel currents for the first region 102-1 based on the subtotals LSS of the estimated pixel currents for segments #0 to #M−1 of the first region 102-1 stored in the current segmentation memory 234-1. In one implementation, the current summation circuitry 236-1 may be configured to calculate the subtotal LTSS by adding up the subtotals LSS of the estimated pixel currents for segments #0 to #M−1 of the first region 102-1. The thus-determined subtotal LTSS of the estimated pixel currents for the first region 102-1 is used as the first region total current data.

The panel total current calculation circuitry 238-1 is configured to determine an estimated total current TPS of the display panel 100 based on the first region total current data received from the current summation circuitry 236-1 and the second region total current data received from the compensation circuitry 226-2 of the second display driver 200-2 via the communication circuitry 222-1. In one implementation, the first region total current data corresponds to the subtotal LTSS of the estimated pixel currents for the first region 102-1 and the second region total current data corresponds to the subtotal RTSS of the estimated pixel currents for the second region 102-2. It is noted that the subtotal RTSS of the estimated pixel currents for the second region 102-2 is determined by the compensation circuitry 226-2 of the second display driver 200-2. The panel total current calculation circuitry 238-1 may be configured to determine the estimated total current TPS of the display panel 100 as the sum of the subtotal LTSS of the estimated pixel currents for the first region 102-1 and the subtotal RTSS of the estimated pixel currents for the second region 102-2. The panel total current calculation circuitry 238-1 may include a total current memory 242-1 configured to store the estimated total current TPS of the display panel 100.

The compensation data generation circuitry 240-1 is configured to generate the compensation data for each pixel in the first region 102-1 based on the estimated total current TPS of the display panel 100 and the position (X, Y) of each pixel. In some embodiments, the compensation data generation circuitry 240-1 may include an LUT 244-1 that describes the correspondence of data values of the compensation data with the estimated total current TPS of the display panel 100 and the position (X, Y) of each pixel. In such embodiments, the compensation data generation circuitry 240-1 may be configured to generate the compensation data through a table lookup on the LUT 244-1. In embodiments where the compensation data include compensation gains, the LUT 244-1 may describe the correspondence of the compensation gains with the estimated total current TPS of the display panel 100 and the position (X, Y) of each pixel.

The compensation data generated by the compensation data generation circuitry 240-1 are forwarded to the correction circuitry 228-1 (illustrated in FIG. 7A) to achieve the IR-drop compensation for the pixels in the first region 102-1.

Figure 10B:
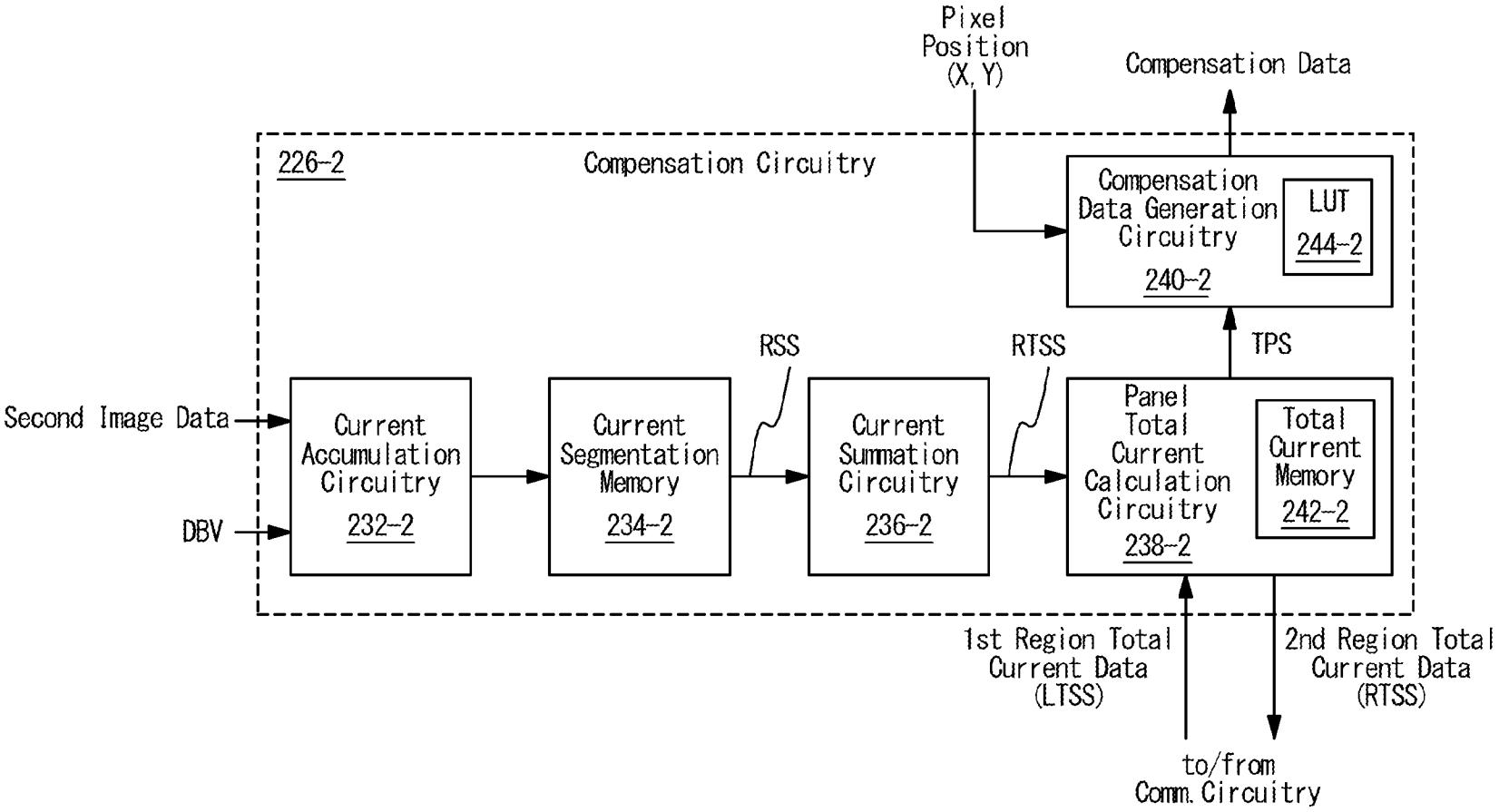
FIG. 10B illustrates an example configuration of compensation circuitry of a second display driver, according to one or more embodiments.

In one or more embodiments, as illustrated in FIG. 10B, the compensation circuitry 226-2 of the second display driver 200-2 is configured similarly to the compensation circuitry 226-1 of the first display driver 200-1 illustrated in FIG. 10A. In the illustrated embodiment, the compensation circuitry 226-2 includes current accumulation circuitry 232-2, current segmentation memory 234-2, current summation circuitry 236-2, and panel total current calculation circuitry 238-2, and compensation data generation circuitry 240-2, which correspond to the current accumulation circuitry 232-1, the current segmentation memory 234-1, the current summation circuitry 236-1, the panel total current calculation circuitry 238-1, and the compensation data generation circuitry 240-1.

The current accumulation circuitry 232-2 is configured to determine estimated pixel currents of respective pixels of each segment in the second region 102-2 based on the second image data for the second region 102-2 and the DBV and determine the subtotal RSS of the estimated pixel currents of each segment in the second region 102-2. The current segmentation memory 234-2 is configured to store the subtotals RSS of the estimated pixel currents of segments #0 to #M−1 of the second region 102-2.

The current summation circuitry 236-2 is configured to determine the subtotal RTSS of the estimated pixel currents for the second region 102-2 based on the subtotals RSS of the estimated pixel currents for segments #0 to #M−1 of the second region 102-2 stored in the current segmentation memory 234-2. In one implementation, the current summation circuitry 236-2 may be configured to calculate the subtotal RTSS by adding up the subtotals RSS of the estimated pixel currents for segments #0 to #M−1 of the second region 102-2. The thus-determined subtotal RTSS of the estimated pixel currents for the second region 102-2 is used as the second region total current data.

The panel total current calculation circuitry 238-2 is configured to determine an estimated total current TPS of the display panel 100 based on the first region total current data received from the compensation circuitry 226-1 of the first display driver 200-1 via the communication circuitry 222-2 and the second region total current data received from the current summation circuitry 236-2. It is noted that the first region total current data corresponds to the subtotal LTSS of the estimated pixel currents for the first region 102-1 and the second region total current data corresponds to the subtotal RTSS of the estimated pixel currents for the second region 102-2. The panel total current calculation circuitry 238-2 may be configured to determine the estimated total current TPS of the display panel 100 as the sum of the subtotal LTSS of the estimated pixel currents for the first region 102-1 and the subtotal RTSS of the estimated pixel currents for the second region 102-2. The panel total current calculation circuitry 238-2 may include a total current memory 242-2 configured to store the estimated total current TPS of the display panel 100.

The compensation data generation circuitry 240-2 is configured to generate the compensation data for each pixel in the second region 102-2 based on the estimated total current TPS of the display panel 100 and the position (X, Y) of each pixel. The compensation data generation circuitry 240-2 may be configured and operated in the same way as the compensation data generation circuitry 240-1 (illustrated in FIG. 10A). In some embodiments, the compensation data generation circuitry 240-2 may include an LUT 244-2 that describes the correspondence of data values of the compensation data with the estimated total current TPS of the display panel 100 and the position (X, Y) of each pixel. In such embodiments, the compensation data generation circuitry 240-2 may be configured to generate the compensation data through a table lookup on the LUT 244-2.

The compensation data generated by the compensation data generation circuitry 240-2 are forwarded to the correction circuitry 228-2 (illustrated in FIG. 7B) to achieve the IR-drop compensation for the pixels in the second region 102-2.

Figure 11:
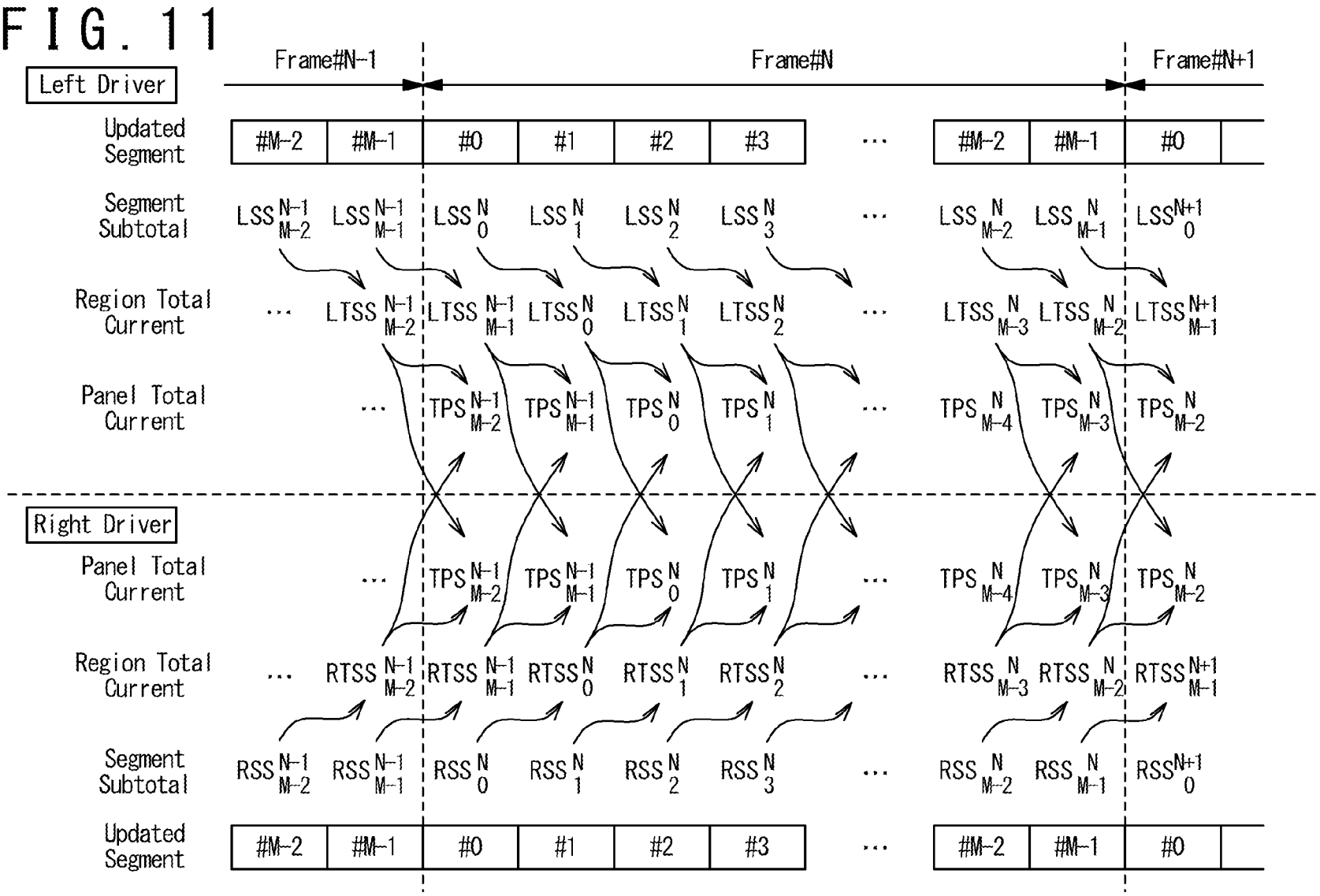
FIG. 11 illustrates example transactions between a first display driver and a second display driver, according to one or more embodiments.

FIG. 11 illustrates example transactions between the first display driver 200-1 (referred to as "Left Driver" in FIG. 11) and the second display driver 200-2 (referred to as "Right Driver" in FIG. 11), according to one or more embodiments. In FIG. 11, "$LSS_i^j$" denotes the subtotal of estimated pixel currents of segment #i of the first region 102-1 upon the update of the segment #i of the first region 102-1 in frame #j, and "$RSS_i^j$" denotes the subtotal of segment #i of the second region 102-2 upon the update of the segment #i of the second region 102-2 in frame #j. "$LTSS_i^j$" denotes the subtotal of estimated pixel currents of the first region 102-1 upon the update of the segment #i of the first region 102-1 in frame #j, and "$RTSS_i^j$" denotes the subtotal of estimated pixel currents of the second region 102-2 upon the update of the segment #i of the second region 102-2 in frame #j. Further, "$TPS_i^j$" denotes the estimated total current of the entire display panel 100 upon the update of the segment #i of the first region 102-1 in frame #j.

The compensation circuitry 226-1 of the first display driver 200-1 (i.e. the left driver) is configured to determine the subtotal LSS of estimated pixel currents of each segment of the first region 102-1 upon the update of each segment of the first region 102-1, and the compensation circuitry 226-2 of the second display driver 200-2 (i.e. the right driver) is configured to determine the subtotal RSS of estimated pixel currents of each segment of the second region 102-2 upon the update of each segment of the second region 102-2.

Further, the compensation circuitry 226-1 of the first display driver 200-1 (i.e., the left driver) is configured to determine and update the subtotal LTSS of the estimated pixel currents of the first region 102-1 in response to the update of each segment of the first region 102-1 and generate first region total current data indicative of the updated subtotal LTSS of the estimated pixel currents of the first region 102-1. The compensation circuitry 226-1 is further configured to transmit the first region total current data to the compensation circuitry 226-2 of the second display driver 200-2. Correspondingly, the compensation circuitry 226-2 of the second display driver 200-2 (i.e., the right driver) is configured to determine and update the subtotal RTSS of the estimated pixel currents of the second region 102-2 upon the update of each segment of the second region 102-2 and generate second region total current data indicative of the updated subtotal RTSS of the estimated pixel currents of the second region 102-2. The compensation circuitry 226-2 is further configured to transmit the second region total current data to the compensation circuitry 226-1 of the first display driver 200-1.

Correspondingly, the compensation circuitry 226-2 of the second display driver 200-2 (i.e., the right driver) is configured to update the subtotal RTSS of the estimated pixel currents of the second region 102-2 in response to the update of each segment of the second region 102-2 and generate second region total current data indicative of the updated subtotal RTSS of the estimated pixel currents of the second region 102-2.

The compensation circuitry 226-1 of the first display driver 200-1 and the compensation circuitry 226-2 of the second display driver 200-2 are further configured to update the estimated total current TPS of the display panel 100 based on the first region total current data and the second region total current data in response to the update of each segment of the first region 102-1 and the second region 102-2. As described above, the estimated total current TPS of the display panel 100 may be determined as the sum of the subtotal LTSS of the estimated pixel currents of the first region 102-1 and the subtotal RTSS of the estimated pixel currents of the second region 102-2.

In the illustrated embodiments, the subtotal of the estimated pixel currents of each segment determined in each segment update period is reflected to the determination of the estimated total current TPS with a delay of two segment update periods, one of which is used to determine and exchange of the first region total current data and the second region total current data, and the other is used to determination of the estimated total current TPS based on the first region total current data and the second region total current data. In the following, a description is given of example determinations of the subtotal LTSS of the estimated pixel currents of the first region 102-1, the subtotal RLSS of the estimated pixel currents of the second region 102-2, and the estimated total current TPS of the display panel 100.

(1) Segment Update Period #0 of Frame #N

In one implementation, the estimated total current $TPS_{M-2}^{N-1}$ is used for the IR-drop compensation for the pixels of segments #0 of the first region 102-1 and the second region 102-2 during the segment update period #0, where $TPS_{M-2}^{N-1}$ is the estimated total current of the display panel 100 upon the update of the segments #M−2 of the first region 102-1 and the second region 102-2 in frame #N−1. The estimated total current $TPS_{M-2}^{N-1}$ is calculated as the sum of $LTSS_{M-2}^{N-1}$ and $RTSS_{M-2}^{N-1}$ that are exchanged between the first display driver 200-1 and the second display driver 200-2 in final segment update period #M−1 of frame #N−1. It is noted that $LTSS_{M-2}^{N-1}$ is the subtotal of the estimated pixel currents of the first region 102-1 upon the update of the segments #M−2 of the first region 102-1 and the second region 102-2 in frame #N−1, and the subtotal $RTSS_{M-2}^{N-1}$ of estimated pixel currents of the second region 102-2 upon the update of the segments #M−2 of the first region 102-1 and the second region 102-2 in frame #N−1. In one implementation, $LTSS_{M-2}^{N-1}$ may be determined in accordance with the following expression (1a) and $RTSS_{M-2}^{N-1}$ may be determined in accordance with the following expression (1b).

$$LTSS_{M-2}^{N-1} = LSS_{M-1}^{N-2} + \sum_{i=0}^{M-2} LSS_i^{N-1}, \text{ and} \tag{1a}$$

$$RTSS_{M-2}^{N-1} = RSS_{M-1}^{N-2} + \sum_{i=0}^{M-2} RSS_i^{N-1}, \tag{1b}$$

where $LSS_{M-1}^{N-2}$ is the subtotal of estimated pixel currents of segment #M−1 of the first region 102-1 upon the update of the segment #M−1 of the first region 102-1 in frame #N−2, and $RSS_{M-2}^{N-1}$ is the subtotal of segment #M−1 of the second region 102-2 upon the update of the segment #M−1 of the second region 102-2 in frame #N−2.

(2) Segment Update Period #1 of Frame #N

In one implementation, the estimated total current $TPS_{M-1}^{N-1}$ is used for the IR-drop compensation for the pixels of segments #1 of the first region 102-1 and the second region 102-2 during the segment update period #1, where $TPS_{M-2}^{N-1}$ is the estimated total current of the display panel 100 upon the update of the segments #M−1 of the first region 102-1 and the second region 102-2 in frame #N−1. The estimated total current $TPS_{M-1}^{N-1}$ is calculated as the sum of $LTSS_{M-1}^{N-1}$ and $RTSS_{M-1}^{N-1}$ that are exchanged between the first display driver 200-1 and the second display driver 200-2 in segment update period #0 of frame #N. In one implementation, $LTSS_{M-1}^{N-1}$ may be determined in accordance with the following expression (2a) and $RTSS_{M-1}^{N-1}$ may be determined in accordance with the following expression (2b).

$$LTSS_{M-1}^{N-1} = \sum_{i=0}^{M-1} LSS_i^{N-1}, \text{ and} \tag{2a}$$

$$RTSS_{M-1}^{N-1} = \sum_{i=0}^{M-1} RSS_i^{N-1}. \tag{2b}$$

(3) Segment Update Periods #2 to #M−1 of Frame #N

In one implementation, the estimated total current $TPS_{k-2}^{1}$ is used for the IR-drop compensation for the pixels of segments #k of the first region 102-1 and the second region 102-2 during the segment update period #k for k being an integer from 2 to M−1, where $TPS_{k-2}^{N}$ is the estimated total current of the display panel 100 upon the update of the segments #k−2 of the first region 102-1 and the second region 102-2 in frame #N. It is noted the parameter k−2 results from the delay of two segment update periods. The estimated total current $TPS_{k-2}^{N}$ is calculated as the sum of $LTSS_{k-2}^{N}$ and $RTSS_{k-2}^{N}$, which are exchanged between the first display driver 200-1 and the second display driver 200-2 in segment update period #k−1 of frame #N. In one implementation, $LTSS_{k-2}^{N}$ may be determined in accordance with the following expression (3a) and $RTSS_{k-2}^{N}$ may be determined in accordance with the following expression (3b).

$$LTSS_{k-2}^{N} = \sum_{i=k-1}^{M-1} LSS_i^{N-1} + \sum_{i=0}^{k-2} LSS_i^{N}, \text{ and} \tag{3a}$$

$$RTSS_{k-2}^{N} = \sum_{i=k-1}^{M-1} RSS_i^{N-1} + \sum_{i=0}^{k-2} RSS_i^{N}. \tag{3b}$$

For segment update period #2 of Frame #N, for example, the estimated total current $TPS_0^N$, which is used for the IR-drop compensation for the pixels of segments #2 of the first region 102-1 and the second region 102-2, is determined as the sum of LTSS" and $RTSS_0^N$, where $LTSS_0^N$ is the subtotal of the estimated pixel currents of the first region 102-1 upon the update of the segments #0 of the first region 102-1 and the second region 102-2 in frame #N, and the subtotal $RTSS_0^N$ of estimated pixel currents of the second region 102-2 upon the update of the segments #0 of the first region 102-1 and the second region 102-2 in frame #N. In one implementation, $LTSS_0^N$ may be determined in accordance with the following expression (4a) and $RTSS_0^N$ may be determined in accordance with the following expression (4b).

$$LTSS_0^N = \sum_{i=1}^{M-1} LSS_i^{N-1} + LSS_0^N, \text{ and} \tag{4a}$$

$$RTSS_0^N = \sum_{i=1}^{M-1} RSS_i^{N-1} + RSS_0^N. \tag{4b}$$

The above-described scheme achieves the determination of the estimated total current of the display panel 100 based on the subtotals of the estimated pixel currents corresponding to the actually-displayed image for at least M−2 of the M segments for each of the first and second regions 102-1 and 102-2, offering an IR-drop compensation with improved accuracy. For example, upon the update of the segments #2 of the first region 102-1 and the second region 102-2 in frame #N, the images displayed in segments #0 to #2 are based on image data for frame #N, and the images displayed in segments #3 to #M−1 are based on image data for frame #N−1. The above-described expressions (4a) and (4b) implies that $LTSS_0^N$ and $RTSS_0^N$ are generated to reflect the images actually displayed in the M segments other than segments #1 and #2 (i.e., the images displayed in segment #0 and segments #3 to #M−1) for each of the first and second regions 102-1 and 102-2. The same applies to other segments of the first region 102-1 and the second region 102-2.

While the above-given description related to the attached drawings is based on display devices in which a display panel is driven by two display drivers, those skilled in the art would appreciate that the technical concept of this disclosure also applies to display devices with three or more display drivers. In embodiments where a display panel is driven by q display drivers for q being a natural number of three or more, for example, the display panel may be segmented into q regions, and the q display drivers are each configured to update a corresponding one of the q regions. The q display drivers may be each configured to generate region total current data corresponding to a subtotal of estimated pixel currents of respective pixels in the corresponding region. The q display drivers may be further configured to share the region total current data of the q regions via a communication bus, and each of the q display drivers may be configured to receive the region total current data from other display drivers. Each of the q display drivers may be further configured to receive image data for the corresponding region, generate voltage data based on the image data, and update the corresponding region based on the voltage data. Each of the q display drivers may be further configured to perform an IR-drop compensation based on the region total current data generated by the respective display drivers in generating the voltage data. In one implementation, each of the q display drivers may be further configured to determine an estimated total current of the display panel based on the region total current data generated by the respective display drivers, and the IR-drop compensation may be based on the estimated total current of the display panel.

Figure 12:
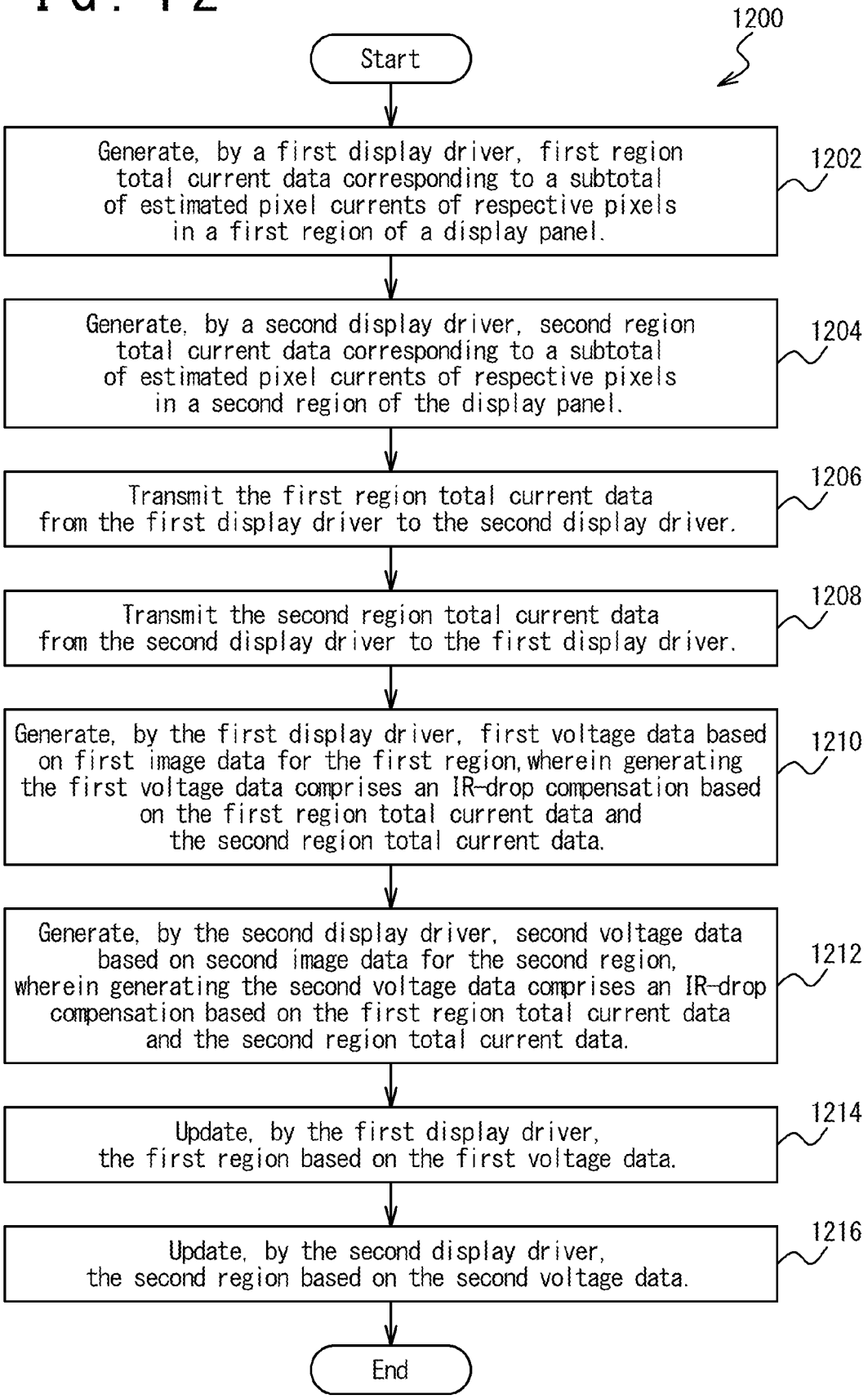
FIG. 12 illustrates an example method of driving a display panel, according to one or more embodiments.

Method 1200 of FIG. 12 illustrates steps for driving a display panel (e.g., the display panel 100 illustrated in FIGS. 4 to 6). It is noted that one or more of the steps illustrated in FIG. 12 may be omitted, repeated, and/or performed in a different order than the order illustrated in FIG. 12. It is further noted that two or more steps may be implemented at the same time.

The method 1200 includes generating, by a first display driver (e.g., the first display driver 200-1 illustrated in FIGS. 4 to 6), first region total current data corresponding to a subtotal of estimated pixel currents of respective pixels in a first region (e.g., the first region 102-1) of a display panel at step 1202. The method 1200 further includes generating, by a second display driver (e.g., the second display driver 200-2), second region total current data corresponding to a subtotal of estimated pixel currents of respective pixels in a second region (e.g., the second region 102-2) of the display panel at step 1204. The method 1200 further includes transmitting the first region total current data from the first display driver to the second display driver at step 1206 and transmitting the second region total current data from the second display driver to the first display driver at step 1208. The method 1200 further includes generating, by the first display driver, first voltage data based on first image data for the first region at step 1210. Generating the first voltage data includes an IR-drop compensation based on the first region total current data and the second region total current data. The method 1200 further includes generating, by the second display driver, second voltage data based on second image data for the second region at step 1212. Generating the second voltage data includes an IR-drop compensation based on the first region total current data and the second region total current data. The method 1200 further includes updating, by the first display driver, the first region based on the first voltage data at step 1214 and updating, by the second display driver, the second region based on the second voltage data at step 1216.

While many embodiments have been described, those skilled in the art, having benefit of this disclosure, will appreciate that other embodiments can be devised which do not depart from the scope. Accordingly, the scope of the invention should be limited only by the attached claims.

What is claimed is:

1. A display system, comprising:

a display panel comprising:

a first region; and a second region;

a first display driver configured to generate first region total current data corresponding to a subtotal of estimated pixel currents of respective pixels in the first region;

a second display driver configured to generate second region total current data corresponding to a subtotal of estimated pixel currents of respective pixels in the second region;

wherein the first display driver is further configured to:

receive the second region total current data from the second display driver;

receive first image data for the first region;

generate first voltage data based on the first image data; and update the first region of the display panel based on the first voltage data, wherein generating the first voltage data comprises an IR-drop compensation based on the first region total current data and the second region total current data.

2. The display system of claim 1, wherein the first display driver is further configured to determine an estimated total current of the display panel based on the first region total current data and the second region total current data, and wherein the IR-drop compensation is based on the estimated total current of the display panel.

3. The display system of claim 1, wherein the IR-drop compensation for a pixel in the first region is based on a position of the pixel.

4. The display system of claim 1, wherein the second display driver is further configured to:

receive the first region total current data from the first display driver;

receive second image data for the second region;

generate second voltage data based on the second image data; and update the second region of the display panel based on the second voltage data, wherein generating the second voltage data comprises an IR-drop compensation based on the first region total current data and the second region total current data.

5. The display system of claim 1, wherein the first region comprises a plurality of first segments, wherein generating the first region total current data comprises:

determining subtotals of estimated pixel currents for the first segments, respectively; and generating the first region total current data based on a sum of the subtotals determined for the first segments.

6. The display system of claim 5, wherein the first display driver is configured to:

sequentially receive image data for the plurality of the first segments; and sequentially update the plurality of first segments based on the image data.

7. The display system of claim 5, wherein the first display driver is configured to generate the first region total current data based on the sum of the subtotals determined for the first segments in response to an update of each of the plurality of first segments.

8. The display system of claim 5, wherein the first display driver is further configured to determine an estimated total current of the display panel based on the first region total current data and the second region total current data in response to an update of each of the plurality of first segments, and wherein the IR-drop compensation is based on the estimated total current of the display panel.

9. The display system of claim 5, wherein the second region comprises a plurality of second segments, wherein generating the second region total current data comprises:

determining subtotals of estimated pixel currents for the second segments, respectively; and generating the second region total current data based on a sum of the subtotals determined for the second segments.

10. The display system of claim 9, wherein the plurality of first segments are each comprised of one or more rows of pixels arranged in a horizontal direction, wherein the plurality of second segments are each comprised of one or more rows of pixels arranged in the horizontal direction, wherein the plurality of first segments are arranged vertically to form the first region of the display panel, wherein the plurality of second segments are arranged vertically to form the second region of the display panel, and wherein the second region is horizontally adjacent to the first region.

11. The display system of claim 9, wherein the second display driver is configured to transmit the second region total current data to the first display driver in response to an update of each of the plurality of second segments.

12. A display driver, comprising:

image processing circuitry configured to:

receive image data for a first region of a display panel;

generate first region total current data corresponding to a subtotal of estimated pixel currents of respective pixels in the first region based on the image data; and generate voltage data from the image data for the first region;

driver circuitry configured to update the first region based on the voltage data; and communication circuitry configured to receive second region total current data from a second display driver, the second region total current data corresponding to a subtotal of estimated pixel currents of respective pixels in a second region of the display panel, wherein generating the voltage data comprises an IR-drop compensation based on the first region total current data and the second region total current data.

13. The display driver of claim 12, wherein the communication circuitry is further configured to transmit the first region total current data to the second display driver.

14. The display driver of claim 12, wherein the first region comprises a plurality of first segments, wherein generating the first region total current data comprises:

determining subtotals of estimated pixel currents for the first segments, respectively; and generating the first region total current data based on a sum of the subtotals determined for the first segments.

15. The display driver of claim 14, wherein generating the first region total current data comprises generating the first region total current data based on the sum of the subtotals determined for the first segments in response to an update of each of the plurality of first segments.

16. The display driver of claim 14, wherein the image processing circuitry is further configured to determine an estimated total current of the display panel based on the first region total current data and the second region total current data in response to an update of each of the plurality of first segments, and wherein the IR-drop compensation is based on the estimated total current of the display panel.

17. A method, comprising:

generating, by a first display driver, first region total current data corresponding to a subtotal of estimated pixel currents of respective pixels in a first region of a display panel;

generating, by a second display driver, second region total current data corresponding to a subtotal of estimated pixel currents of respective pixels in a second region of the display panel;

transmitting the second region total current data from the second display driver to the first display driver;

generating, by the first display driver, first voltage data based on first image data for the first region, wherein generating the first voltage data comprises an IR-drop compensation based on the first region total current data and the second region total current data; and updating the first region based on the first voltage data.

18. The method of claim 17, further comprising:

transmitting the first region total current data from the first display driver to the second display driver;

generating, by the second display driver, second voltage data based on second image data for the second region, wherein generating the second voltage data comprises an IR-drop compensation based on the first region total current data and the second region total current data; and updating the second region of the display panel based on the second voltage data.

19. The method of claim 17, wherein the first region comprises a plurality of first segments, wherein generating the first region total current data comprises:

determining subtotals of estimated pixel currents for the first segments, respectively; and generating the first region total current data based on a sum of the subtotals determined for the first segments.

20. The method of claim 17, wherein the second region comprises a plurality of second segments, wherein generating the second region total current data comprises:

determining subtotals of estimated pixel currents for the second segments, respectively; and generating the second region total current data based on a sum of the subtotals determined for the second segments.

* * * * *